US009307879B2

(12) United States Patent
Fagre

(10) Patent No.: US 9,307,879 B2
(45) Date of Patent: Apr. 12, 2016

(54) BODY POSITIONING SYSTEMS

(71) Applicant: Fagre Enterprises, LLC, Gilbert, AZ (US)

(72) Inventor: Jose Luis Fagre, Miranda (VE)

( * ) Notice: Subject to any disclaimer, the term of this patent is extended or adjusted under 35 U.S.C. 154(b) by 355 days.

(21) Appl. No.: 13/734,580

(22) Filed: Jan. 4, 2013

(65) Prior Publication Data

US 2013/0174337 A1 Jul. 11, 2013

Related U.S. Application Data

(60) Provisional application No. 61/585,168, filed on Jan. 10, 2012.

(51) Int. Cl.
*E03D 11/00* (2006.01)
*A47K 17/02* (2006.01)

(52) U.S. Cl.
CPC ..... *A47K 17/028* (2013.01)

(58) Field of Classification Search
CPC ..... A47K 17/00; A47K 17/02; A47K 17/028; A47C 16/02; A47C 7/52; A47C 9/00
USPC ..... 4/661, 254; 297/423.1, 423.39, 423.41; D6/349, 350; D23/296
See application file for complete search history.

(56) References Cited

U.S. PATENT DOCUMENTS

| | | | | | |
|---|---|---|---|---|---|
| 259,883 | A * | 6/1882 | Mander | 297/423.41 |
| 740,071 | A * | 9/1903 | Allen | 297/423.41 |
| 1,798,632 | A * | 3/1931 | Romer | 4/254 |
| 2,341,080 | A * | 2/1944 | Burkholder | 297/423.46 |
| 2,834,028 | A * | 5/1958 | Stanley | 4/254 |
| D251,278 | S * | 3/1979 | Rosenthal | D6/349 |
| 4,244,064 | A * | 1/1981 | Parr | 4/254 |
| D268,796 | S | 5/1983 | Kola | |
| 4,713,846 | A | 12/1987 | Hodroski, Jr. | |
| D297,789 | S | 9/1988 | Stepien | |
| D297,790 | S * | 9/1988 | Melvin | D6/350 |
| 4,979,240 | A | 12/1990 | Welles | |
| 4,991,908 | A * | 2/1991 | Krechel | 297/423.41 |
| 5,028,024 | A | 7/1991 | Welles | |
| D335,966 | S * | 6/1993 | Schwartzkopf et al. | D6/350 |
| 5,553,334 | A | 9/1996 | Hillman | |
| 6,148,448 | A | 11/2000 | Urso | |
| 6,206,805 | B1 | 3/2001 | Helton et al. | |
| 6,256,800 | B1 | 7/2001 | Isbit | |
| 6,681,410 | B1 | 1/2004 | Husain | |
| 7,748,786 | B1 * | 7/2010 | Brower | 297/423.41 |
| 7,814,581 | B1 | 10/2010 | Willner | |
| 2003/0047979 | A1 * | 3/2003 | Carom | 297/423.45 |
| 2006/0179559 | A1 | 8/2006 | Palazzolo | |
| 2010/0263114 | A1 | 10/2010 | Nagy | |
| 2011/0099701 | A1 | 5/2011 | Rane | |
| 2011/0179563 | A1 | 7/2011 | Chern et al. | |

FOREIGN PATENT DOCUMENTS

| | | | | |
|---|---|---|---|---|
| ES | EP0682906 A2 * | 11/1995 | | 4/254 |

* cited by examiner

*Primary Examiner* — Lauren Crane
*Assistant Examiner* — Erin Deery
(74) *Attorney, Agent, or Firm* — Lodestar Patents, PLLC; Raymond J. E. Hall

(57) ABSTRACT

A system related to providing elevated support and positioning of the feet to place the body of a user in a posture facilitating bowel elimination during seated-position toilet use.

17 Claims, 8 Drawing Sheets

BODY POSITIONING SYSTEMS

CROSS-REFERENCE TO RELATED APPLICATION

The present application is related to and claims priority from prior provisional application Ser. No. 61/585,168, filed Jan. 10, 2012, entitled "BODY POSITIONING SYSTEMS", the contents of which is incorporated herein by this reference and is not admitted to be prior art with respect to the present invention by the mention in this cross-reference section.

BACKGROUND

This invention relates to providing improved body positioning systems. More particularly, this invention relates to a system providing elevated support and positioning of the feet to place the body of a user in a posture facilitating bowel elimination during seated-position toilet use.

The users of western-style toilets are usually seated in a chair-like position, which represents a significant departure from the squatting position used by humans for the majority of their existence. Historically, humans have used a natural squatting position that places the femurs of the upper legs canted at an upward angle. This more ideal body position has several advantages, including: proper alignment of the lower gastrointestinal tract, better utilization of the abdominal muscles, and reduced strain on the sphincter muscles.

Until conventional western-style toilets are replaced by more biomechanically-compatible fixtures, a need exists for an inexpensive and useful means for beneficially positioning a user's body in a posture facilitating bowel elimination during seated-position toilet use.

OBJECTS AND FEATURES OF THE INVENTION

A primary object and feature of the present invention is to provide a system overcoming the above-mentioned problem(s). It is a further object and feature of the present invention to provide such a system assisting beneficial positioning of the body during use of a conventional seated-position toilet. It is another object and feature of the present invention to provide such a system that provides fixed support of the feet, most preferably offering at least two distinct foot elevations and foot angles.

It is a further object and feature of the present invention to provide such a system that is both stable and light weight. It is another object and feature of the present invention to provide such a system that can be easily moved from place to place and stowed when not in use.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides an apparatus relating to assisting support and positioning of a human body, in at least one posture facilitating defecation during the use of a seated-position toilet, such apparatus comprising: at least one positioner structured and arranged to position the body of a seated user during use of the seated-position toilet; wherein such at least one positioner comprises at least one first-plane foot supporter structured and arranged to support, during use of the seated-position toilet, at least one foot of the seated user in a first planar foot-support position above a floor surface adjacent the seated-position toilet, second-plane foot supporter means for supporting, during use of the seated-position toilet, at least one foot of the seated user in a second planar foot support position above the floor surface, and at least one fixed-geometry establisher structured and arranged to establish a fixed non-adjustable geometric relationship between such at least one first-plane foot supporter and such at least one second-plane foot supporter; wherein such first planar foot support position comprises a different plane from such second planar foot support position; wherein at least one of such at least one first-plane foot supporter and such at least one second-plane foot supporter comprises at least one non-horizontal angle; wherein such at least one positioner is configured to be hand carried; and wherein such apparatus assists support and positioning of the body of the seated user, in the posture facilitating defecation during use of a seated-position toilet.

Moreover, it provides such an apparatus further comprising: at least one shape conformer structured and arranged to conform at least one of such at least one non-adjustable-geometry establisher, such at least one first-plane foot supporter, and such at least one second-plane foot supporter to at least one outer surface of the seated-position toilet; wherein such at least one shape conformer is further configured to permit placement of such at least one positioner, adjacent the seated-position toilet, such that a plane passing through at least two of such at least one first-plane foot supporter and such at least one second-plane foot supporter intersects at least one portion of the seated-position toilet. Additionally, it provides such an apparatus further comprising: at least one third-plane foot supporter structured and arranged to support, during use of the seated-position toilet, at least one foot of the seated user in a third planar foot-support position above the floor surface adjacent the seated-position toilet; wherein such at least one third planar foot-support position comprises at least one non-horizontal angle differing from such first planar foot support position and such second planar foot support position.

Also, it provides such an apparatus wherein such at least one first-plane foot supporter further comprises: at least one first-plane support surface having a heel-adjacent portion and a toe-adjacent portion; wherein such at least one first-plane support surface slopes upwardly from such heel-adjacent portion to such toe-adjacent portion at an angle of about five degrees from horizontal. In addition, it provides such an apparatus wherein such at least one first-plane support surface further comprises: a length, as measured between such heel-adjacent portion and such toe-adjacent portion, of between about 8 centimeters and about 16 centimeters; and a minimum elevation, as measured at such heel-adjacent portion, of between about six centimeters and about 12 centimeters above the floor surface. And, it provides such an apparatus wherein such second-plane foot supporter comprises: at least one second-plane support surface having a heel-adjacent portion and a toe-adjacent portion; and a minimum elevation, as measured at such heel-adjacent portion, of between about 12 centimeters and about 28 centimeters above the floor surface; wherein such at least one second-plane support surface slopes upwardly from such heel-adjacent portion to such toe-adjacent portion at an angle of about 23 degrees from horizontal. Further, it provides such an apparatus wherein, during use of the seated-position toilet, such first-plane foot supporter is configured to assist in positioning the femur of the upper limb between about 2 degrees and about 16 degrees above horizontal.

Even further, it provides such an apparatus wherein, during use of the seated-position toilet, such first-plane foot supporter is configured to assist in positioning the tibia of the lower limb at an angle of between about two degrees and about 16 degrees forward of vertical. Moreover, it provides such an apparatus wherein, during use of the seated-position toilet, such second-plane foot supporter assists in positioning the femur of the upper limb between about 10 degrees and about 26 degrees above horizontal.

Additionally, it provides such an apparatus wherein, during use of the seated-position toilet, such second-plane foot supporter is configured to assist in positioning the tibia of the lower limb at an angle of about 12 degrees to about 30 degrees forward of vertical. Also, it provides such an apparatus wherein such at least one first-plane foot supporter comprises at least one friction enhancer configured to enhance friction between such at least one first-plane support surface and the foot of the user. In addition, it provides such an apparatus wherein such at least one second-plane foot supporter comprises at least one friction enhancer configured to enhance friction between such at least one first-plane support surface and the foot of the user. And, it provides such an apparatus wherein such at least one friction enhancer comprises instructional indicia. Further, it provides such an apparatus wherein such at least one positioner comprises a single unitary shell. Even further, it provides such an apparatus wherein such at least one positioner comprises at least one nested-stacking geometry structured and arranged to assist nested stacking of two or more of such at least one positioners.

Even further, it provides such an apparatus wherein such at least one positioner comprises a polymer material. In accordance with another preferred embodiment hereof, this invention provides an apparatus relating to assisting support and positioning of a human body, in at least one posture facilitating defecation during the use of a seated-position toilet, such apparatus comprising: positioner means for positioning the body of a seated user during use of the seated-position toilet; wherein such positioner means comprises first-plane foot supporter means for supporting, during use of the seated-position toilet, at least one foot of the seated user in a first planar foot-support position above a floor surface adjacent the seated-position toilet, second-plane foot supporter means for supporting, during use of the seated-position toilet, at least one foot of the seated user in a second planar foot support position above the floor surface, and fixed-geometry establisher means for establishing a fixed non-adjustable geometric relationship between such first-plane foot supporter means and such second-plane foot supporter means; wherein such first planar foot support position falls within a different plane from such second planar foot support position; wherein at least one of such first-plane foot supporter means and such second-plane foot supporter means comprises at least one non-horizontal angle; wherein such positioner means is configured to be hand carried; and wherein such apparatus assists support and positioning of the body of the seated user, in the posture facilitating defecation during use of a seated-position toilet.

Even further, it provides such an apparatus further comprising: shape conformer means for conforming at least one of such non-adjustable-geometry establisher means, such first-plane foot supporter means, and such second-plane foot supporter means to at least one outer surface of the seated-position toilet; wherein such shape conformer means is further configured to permit placement of such positioner means, adjacent the seated-position toilet, such that a plane passing through at least two of such first-plane foot supporter means and such second-plane foot supporter means intersects at least one portion of the seated-position toilet. Even further, it provides such an apparatus further comprising: third-plane foot supporter means for supporting, during use of the seated-position toilet, at least one foot of the seated user in a third planar foot-support position above a floor surface adjacent the seated-position toilet; wherein such third planar foot-support position comprises at least one non-horizontal angle differing from such first planar foot support position and such second planar foot support position.

In accordance with another preferred embodiment hereof, this invention provides an apparatus relating to assisting support and positioning of a human body, in at least one posture facilitating defecation during the use of a seated-position toilet, such apparatus comprising: at least one positioner structured and arranged to position the body of a seated user during use of the seated-position toilet; wherein such at least one positioner comprises a fixed-geometry integral body having at least two raised foot-supporting platforms each one supporting, during use of the seated-position toilet, at least one foot of the seated user in a second planar foot support position above a floor surface, and three spaced apart support members for supporting the at least two platforms above the floor surface, each support member having a lower end for positionment on the floor surface; and wherein each such at least two raised foot-supporting platforms comprises a unique elevation and planar support angle; wherein such at least one positioner is configured to be hand carried; and wherein such apparatus assists support and positioning of the body of the seated user, in the posture facilitating defecation during use of a seated-position toilet. Even further, it provides such an apparatus wherein such at least one positioner comprises a generally U-shaped horizontal cross section.

In accordance with another preferred embodiment hereof, this invention provides each and every novel feature, element, combination, step and/or method disclosed or suggested by this patent application.

DETAILED DESCRIPTION OF THE BEST MODES AND PREFERRED EMBODIMENTS OF THE INVENTION

Figure 1:
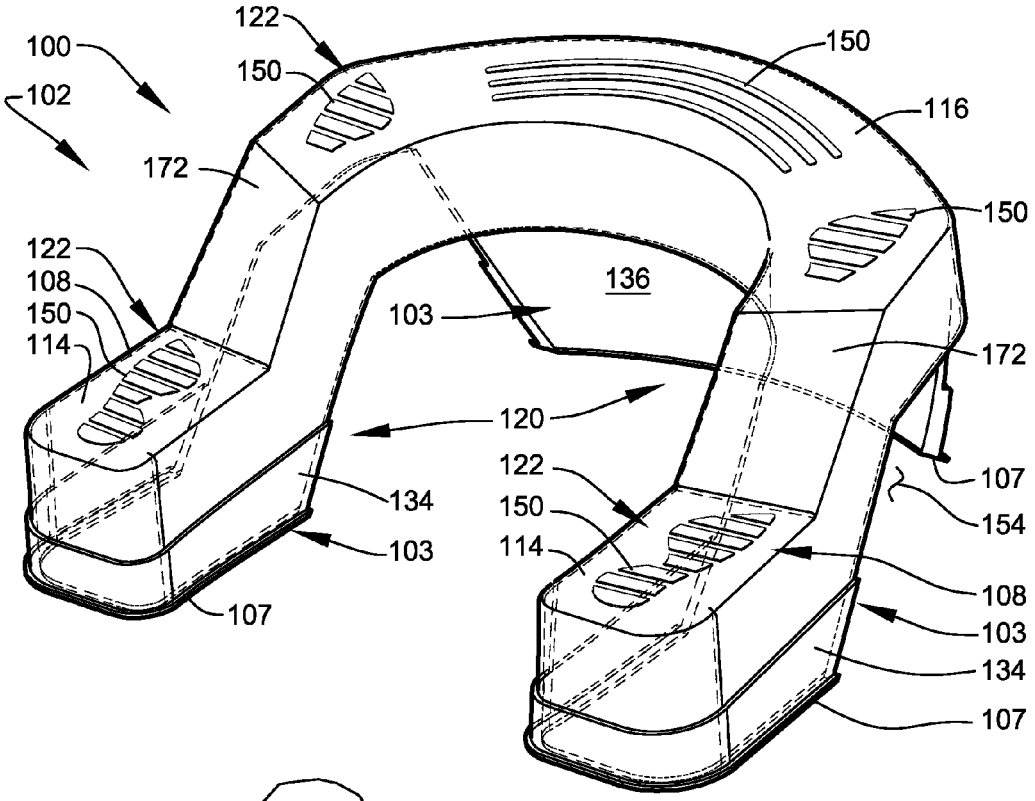
FIG. 1 shows a perspective view illustrating a body positioner to assist support and positioning of a human body, in one or more postures facilitating defecation during the use of a seated-position toilet, according to a preferred embodiment of the present invention.
Figure 2:
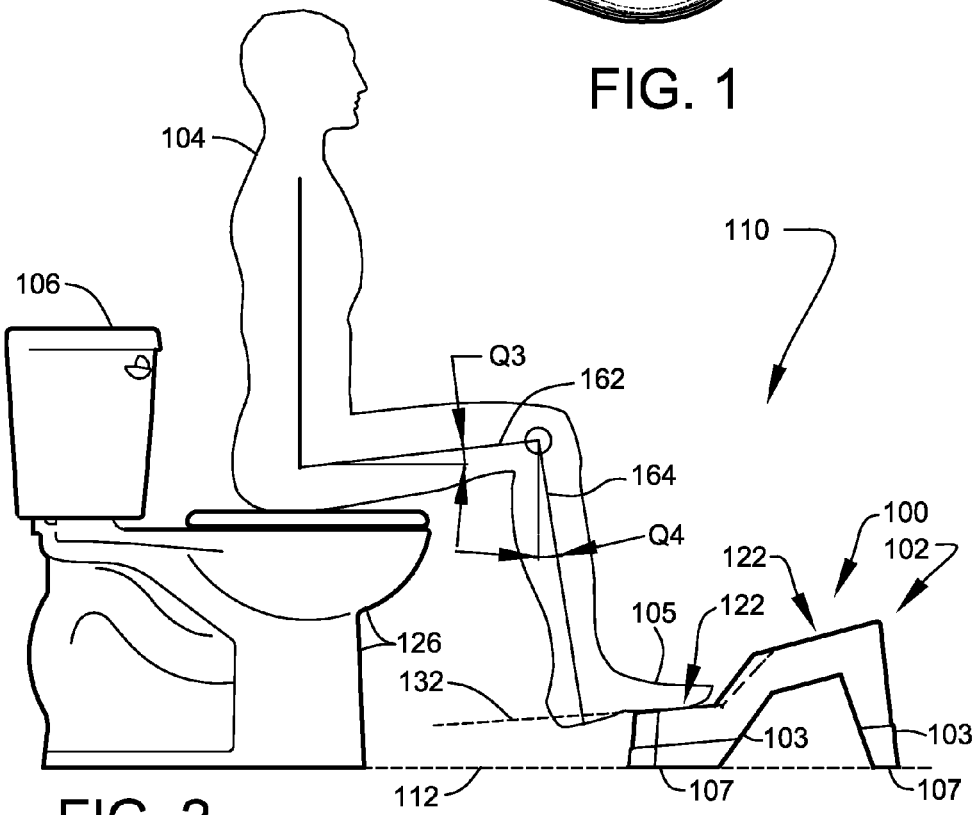
FIG. 2 shows a diagrammatic side view, illustrating a user supported and positioned in a posture facilitating defecation during the use of a seated-position toilet, utilizing the preferred embodiment of FIG. 1.

FIG. 1 shows a perspective view illustrating a body positioner 102 designed to assist support and positioning of a body of a human user 104 in one or more postures facilitating defecation during the use of a conventional western-style seated-position toilet 106. Body positioner 102 of FIG. 1 represents one preferred embodiment of applicant's body positioning systems 100. FIG. 2 shows a diagrammatic side view, illustrating user 104 supported and positioned, by the embodiment of FIG. 1, in a posture facilitating defecation during the use of the seated-position toilet 106.

In general, each body positioner 102 consists of a unitary U-shaped body 120 having multiple-height support surfaces 122 for supporting at least the feet 105. The support surfaces 122 are, in turn, preferably supported by three spaced-apart support members 103, which are preferably formed integrally within the U-shaped body 120, as shown. Each support member 103 has a base portion 107 configured for positionment on floor surface 112, as shown in FIG. 2.

The support surfaces 122 preferably include friction-enhancing surface treatment 150 suggesting foot placement locations. The U-shaped geometry allows the unit to be placed closely adjacent the outer bowl surface 126 of the seated-position toilet 106 (to facilitate a semi-squatting user position shown in FIG. 2). The support surfaces 122 are preferably formed to include slopes to place the body of user 104 in a natural and comfortable position during use.

In more specific terms, each body positioner 102 of the present system (at least embodying herein positioner means for positioning the body of a seated user during use of the seated-position toilet) is preferably configured to supportively position one or more feet 105 of user 104 at one or more elevated and angled positions, which correspondingly places the body of the seated user 104 in one of several biomechanically-beneficial position during use of the seated-position toilet 106.

Body positioner 102 is preferably configured to provide to user 104 at least two distinct foot-support options, as will further described in a later section. Preferably, each body positioner 102 provides at least two distinct foot-angle positions comprising two distinct elevations (relative to the adjacent floor surface 112). This preferred arrangement preferably allows for the placement of the body in one of at least two respective beneficial positions.

Figure 3:
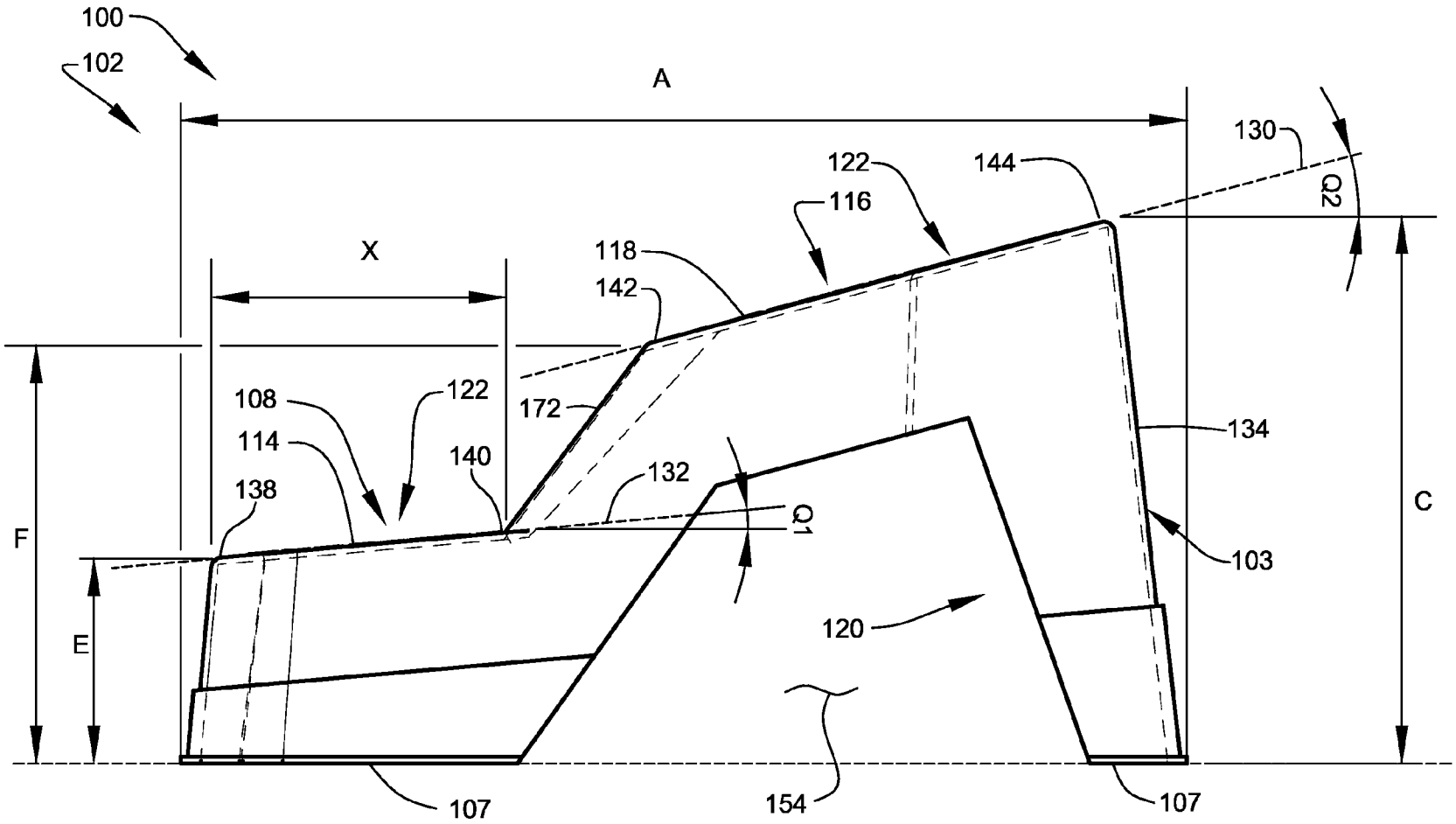
FIG. 3 shows a side view, illustrating the body positioner, according to the preferred embodiment of FIG. 1.

FIG. 3 shows a side view, illustrating body positioner 102, according to the preferred embodiment of FIG. 1. Reference is now made to FIG. 3, with continued reference to FIG. 1 and FIG. 2. The preferred support surfaces 122 of body positioner 102 comprise at least one first-plane foot supporter 108 and at least one second-plane foot supporter 116, as shown. First-plane foot supporter 108 (at least embodying herein first-plane foot supporter means for supporting, during use of the seated-position toilet, at least one foot of the seated user in a first planar foot-support position above a floor surface adjacent the seated-position toilet) is preferably divided into a pair of generally planar support surfaces 114, which are preferably located on opposing proximal sides of the U-shaped body (see FIG. 1). The first pair of generally planar support surfaces 114 are preferably arranged to fall within a single geometric plane 132 (or less preferably, multiple planes). With this preferred arrangement, first-plane foot supporter 108 is preferably configured to simultaneously support the right and left feet 105 of a user 104 in the first planar foot-support position 110 above floor surface 112 generally depicted in FIG. 2 (at least embodying herein at least one first-plane foot supporter structured and arranged to support, during use of the seated-position toilet, at least one foot of the seated user in a first planar foot support position above the floor surface). While in the first planar foot-support position 110, the body of user 104 assumes a more natural conformation during use of seated-position toilet 106. During preferred use of seated-position toilet 106, first-plane foot supporter 108 is preferably configured to assist in positioning the femur 162 of the upper limb at an angle Q3 between about 2 degrees and about 16 degrees above horizontal, with an angle Q3 approaching about 6 degrees from horizontal being most preferred. Furthermore, such first-plane foot supporter is configured to assist in positioning the tibia 164 of the lower limb at an angle Q4 of between about 2 degrees and about 16 degrees forward of vertical, with an angle Q4 approaching about 9 degrees being most preferred.

Figure 8:
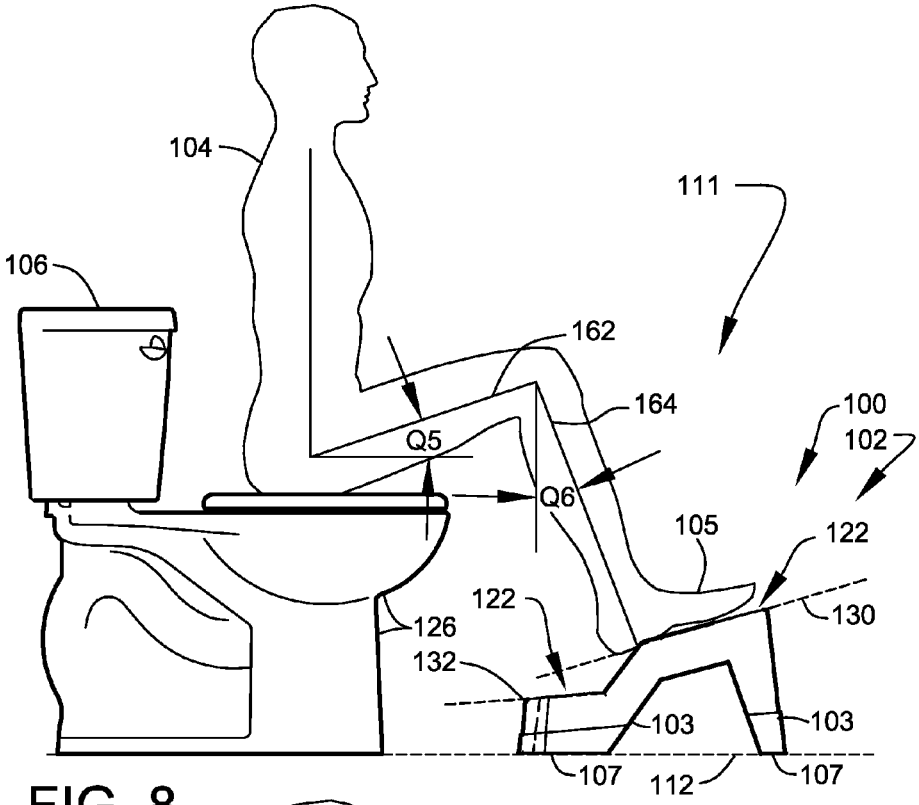
FIG. 8 shows a diagrammatic side view, illustrating a user supported and positioned in an alternate posture facilitating defecation during the use of a seated-position toilet, utilizing the preferred embodiment of FIG. 1.

Second-plane foot supporter 116 of body positioner 102 preferably comprises a second generally planar support surface 118, which generally defines geometric plane 130 that is preferably located at an elevation generally forward and above first-plane foot supporter 108, as shown. Second-plane foot supporter 116 is preferably configured to provide simultaneous planar support of both the right and left feet 105 of user 104 in a second planar foot-support position 111 above floor surface 112, as generally shown in FIG. 8 (at least embodying herein at least one second-plane foot supporter structured and arranged to support, during use of the seated-position toilet, at least one foot of the seated user in a second planar foot support position above the floor surface; and at least embodying herein second-plane foot supporter means for supporting, during use of the seated-position toilet, at least one foot of the seated user in a second planar foot support position above the floor surface).

As shown in the accompanying side view of FIG. 3, geometric plane 130 of second generally planar support surface 118 preferably comprises an orientation differing from the single geometric plane 132 associated with the first pair of generally planar support surfaces 114 (at least embodying herein wherein such first planar foot support position falls within a different plane from such second planar foot support position).

Each body positioner 102 consists of a generally U-shaped body 120 having a single unitary structure of relatively rigid composition. The preferred unitary structure and relatively rigid composition of the unit serves to establish a fixed, non-adjustable, geometric relationship between first-plane foot supporter 108 and second-plane foot supporter 116 (at least embodying herein at least one fixed-geometry establisher structured and arranged to establish a fixed non-adjustable geometric relationship between such at least one first-plane foot supporter and such at least one second-plane foot supporter and further embodying herein fixed-geometry establisher means for establishing a fixed non-adjustable geometric relationship between such first-plane foot supporter means and such second-plane foot supporter means).

Preferably, body positioner 102 is designed to be sufficiently low in mass (weight) such that the unit can be readily lifted and carried by an adult user 104 of normal strength. At the same time, body positioner 102 is preferably designed to comprise a load-bearing structure capable of supporting the typical static and dynamic loads imposed by user 104.

Figure 4:
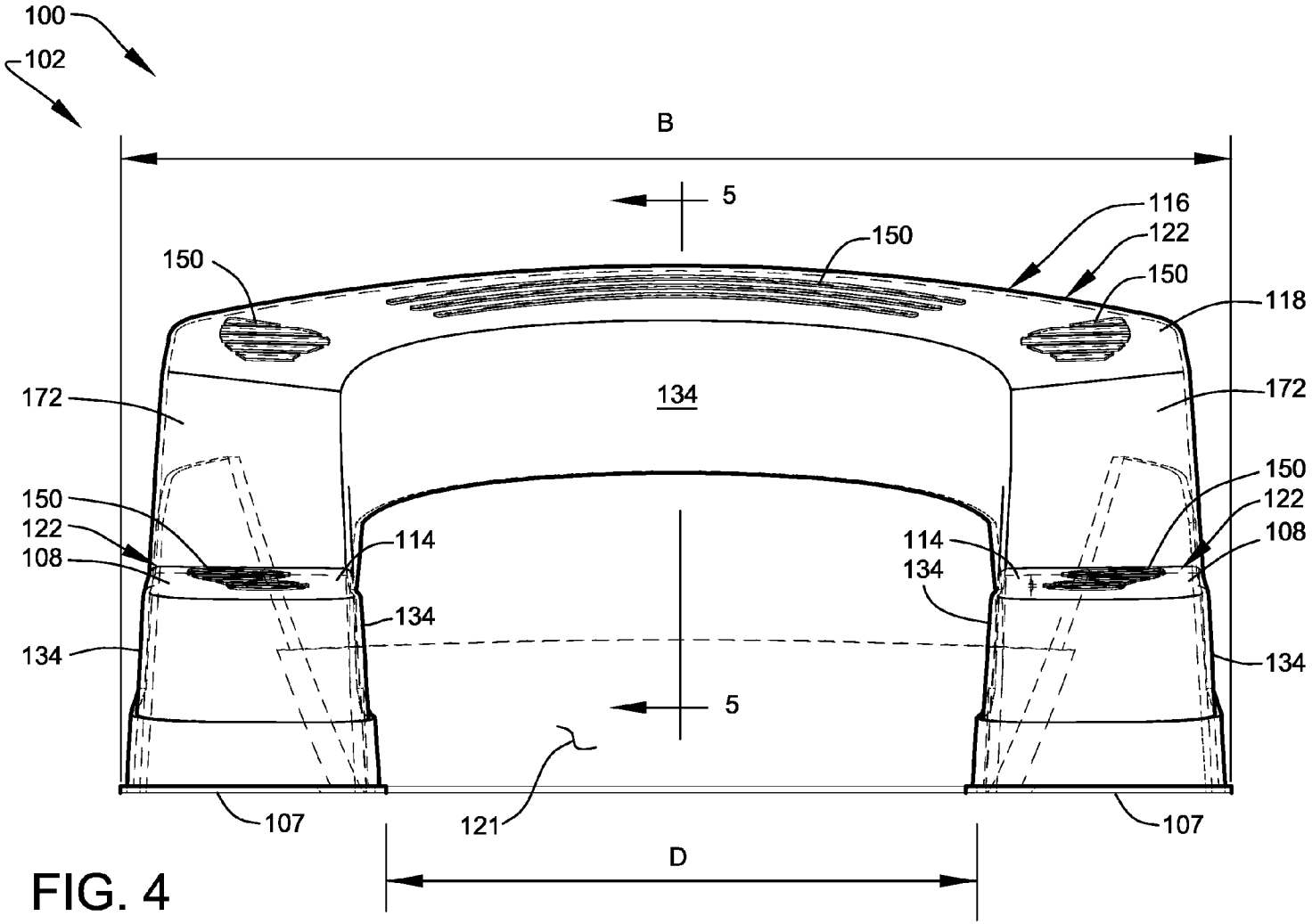
FIG. 4 shows a front view of the body positioner of FIG. 1.
Figure 5:
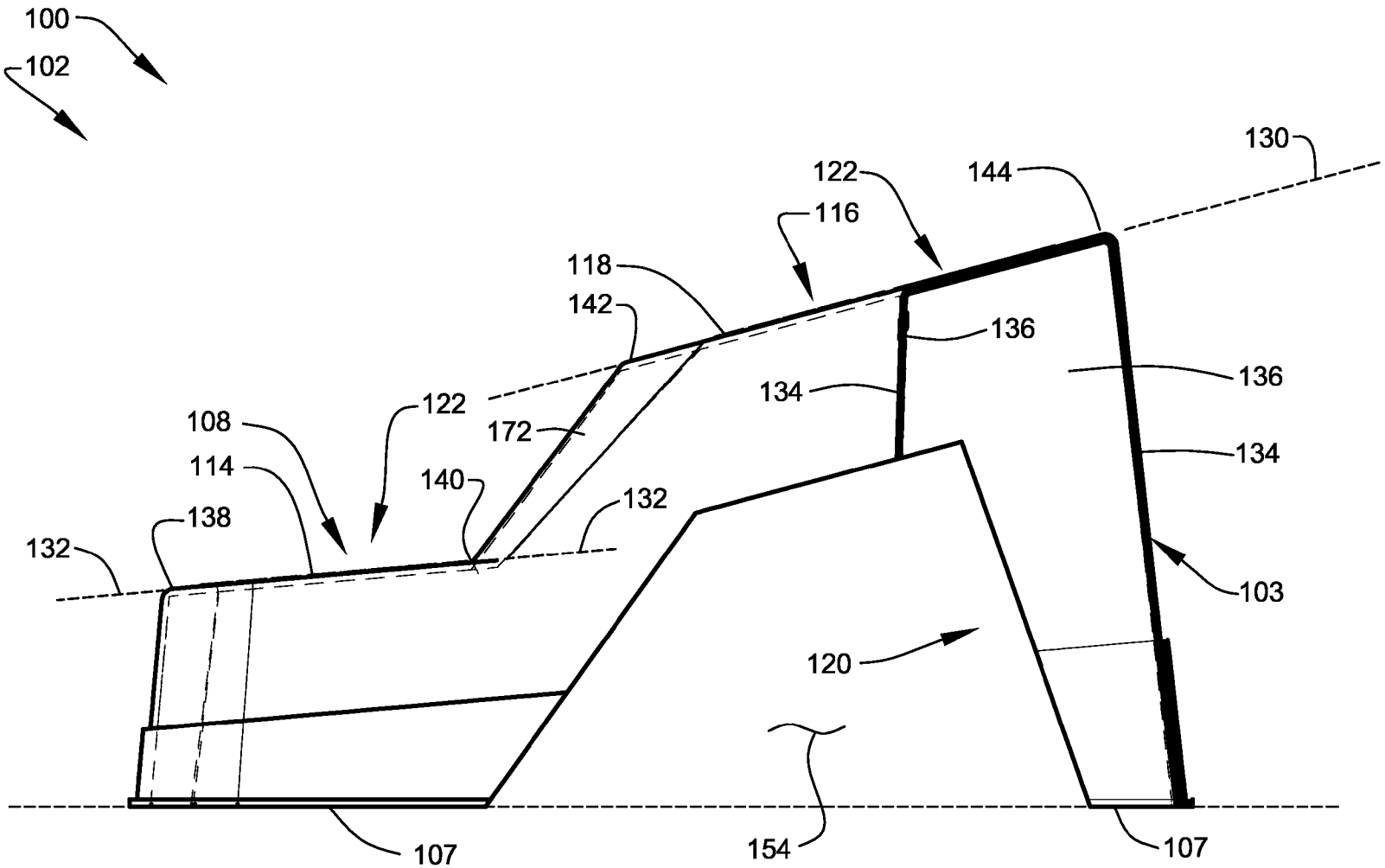
FIG. 5 shows the sectional view 5-5 of FIG. 4 according to the preferred embodiment of FIG. 1.

FIG. 4 shows a front view of body positioner 102 of FIG. 1 and FIG. 5 shows the sectional view 5-5 of FIG. 4. In regard to the depicted embodiment, body positioner 102 develops both load-bearing strength and low weight by comprising a preferred thin-walled shell configuration. It is preferred that body positioner 102 be constructed from a single molded material, with a plastic or a similar polymeric material being most preferred.

The unit is preferably integrally molded by one or more known processes, such as, for example, an injection molding process. A preferred color or colors may be provided to the selected material by coating, mixing or blending the material, forming body positioner 102, with a colorant, pigment, and/or dye, or by other well-known methods. Although it is preferred that a single predominant plastic resin be used in the fabrication of body positioner 102 (apart from possible reinforcements, inert fillers, and other additives) those skilled in the art, upon reading the teachings of this specification, will appreciate that, under appropriate circumstances, the use of two or more, resins, reinforcements, inert fillers, or other additives may suffice. Furthermore, upon reading this specification, those with ordinary skill in the art will now appreciate that, under appropriate circumstances, considering such issues as design preference, user preferences, marketing preferences, cost, structural requirements, available materials, technological advances, etc., other material compositions such as, for example, natural wood or plant fibers, lightweight metals, etc., may suffice.

Figure 11:
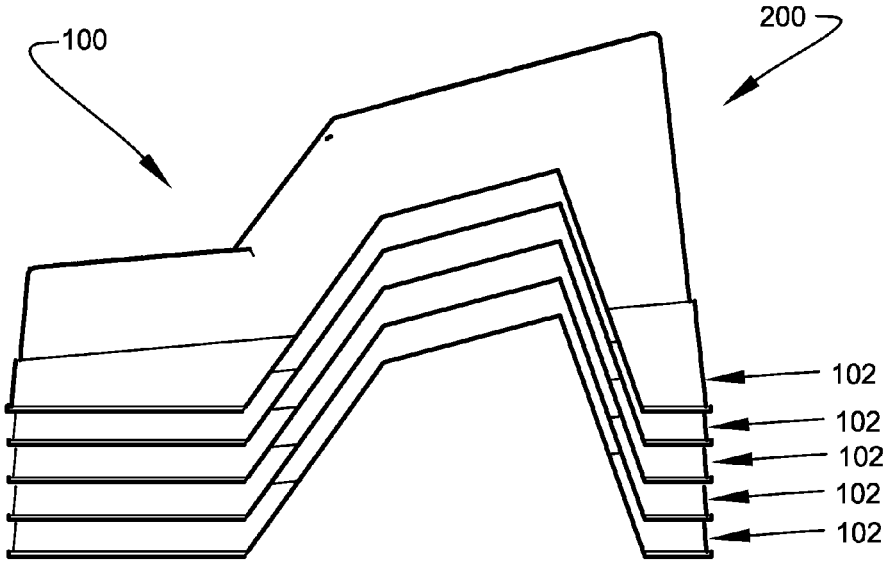
FIG. 11 shows a side view, illustrating a plurality of body positioners, arranged in a nested stack, in a according of FIG. 1 in a stowed position.

The side portions 134 of body positioner 102 preferably incline outwardly approaching the base portion 107 of the unit, as shown. This preferred geometry establishes a set of preferred draft angles intended to facilitate the molding process (i.e., to assist removal of body positioner 102 from the hollow cavity of the mold), improves the balance and stability of the product, and facilitate nested stacking of multiple units, as shown in FIG. 11. According to customary engineering practices in the art of polymer molding, the internal wall surfaces 136 of the shell may preferably comprise one or more raised features (e.g., bosses, ribs, etc.) designed to add strength to the supportive structures of the unit.

In reference to the side view of FIG. 3 and FIG. 4, body positioner 102 comprises an overall length A of about 45 centimeters, an overall width B of about 51 centimeters, and an overall height C of about 24 centimeters. Preferably, the U-shaped opening 121 of the U-shaped body 120 comprises a preferred clear opening width D of about 27 centimeters.

The left-hand side of the illustration of FIG. 3 shows one of the lower first pair of generally planar support surfaces 114. Each generally planar support surface 114 preferably comprise a respective heel-adjacent portion 138 and toe-adjacent portion 140, as shown, which is associated generally with the orientation of the user's foot during normal use. Each generally planar support surface 114 preferably comprises a length X, as measured between such heel-adjacent portion 138 and such toe-adjacent portion 140, of between about 8 centimeters and about 16 centimeters, with a length of about 12 centimeters being most preferred. The first pair of generally planar support surfaces 114 each comprises a minimum elevation E, as measured above floor surface 112 at heel-adjacent portion 138, of between about 6 centimeters and about 12 centimeters with a minimum elevation of about 9 centimeters being most preferred. Preferably, both first-plane support surfaces 114 slope upwardly from heel-adjacent portion 138 to toe-adjacent portion 140, most preferably at angle Q1 comprising about 5 degrees from horizontal (at least embodying herein wherein at least one of such first-plane foot supporter means and such second-plane foot supporter means comprises at least one non-horizontal angle). Upon reading this specification, those with ordinary skill in the art will now appreciate that, under appropriate circumstances, considering such issues as design preference, user preferences, user body size, cost, structural requirements, etc., alternate dimensional and/or angular arrangements such as, for example, larger or smaller support surfaces, steeper or shallower support-surface angles, alternate elevations, etc., may suffice. The upper support surface 122, identified herein as second generally planar support surface 118, also comprises a heel-adjacent portion 142 and a toe-adjacent portion 144, as shown, and preferably comprises a minimum elevation F, as measured at such heel-adjacent portion 142, of between about 12 centimeters and about 28 centimeters above the floor surface with a minimum elevation of about 20 centimeters being most preferred. Preferably, second generally planar support surface 118 slopes upwardly from heel-adjacent portion 142 to toe-adjacent portion 144 at an angle Q2 of about 23 degrees from horizontal (at least embodying herein wherein at least one of such first-plane foot supporter means and such second-plane foot supporter means comprises at least one non-horizontal angle). Upon reading this specification, those with ordinary skill in the art will now appreciate that, under appropriate circumstances, considering such issues as design preference, user preferences, user body size, cost, structural requirements, etc., alternate dimensional and/or angular arrangements such as, for example, larger or smaller support surfaces, steeper or shallower support-surface angles, alternate elevations, etc., may suffice.

Figure 6:
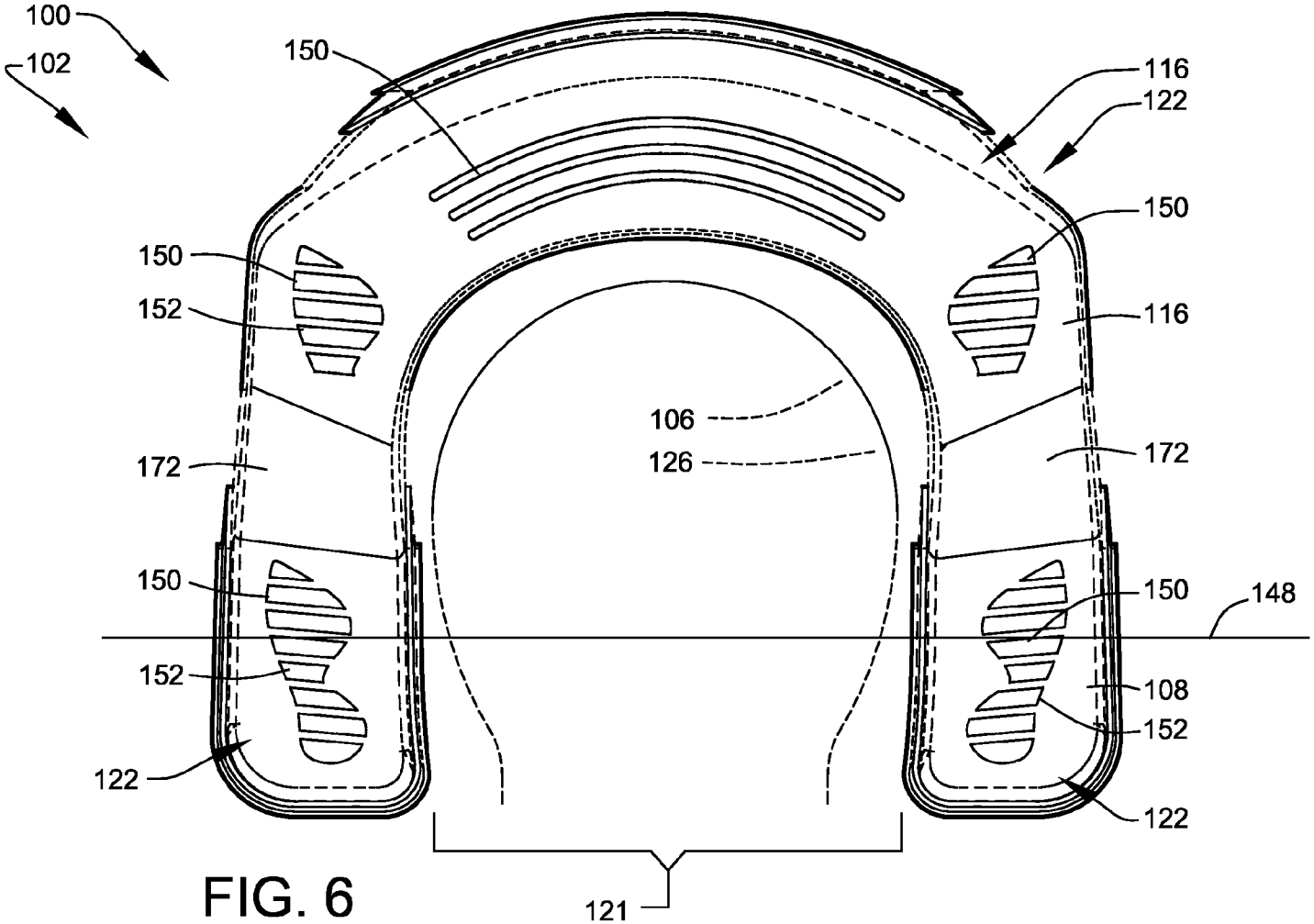
FIG. 6 shows a top view of the body positioner of FIG. 1.

FIG. 6 shows a top view of body positioner 102 of FIG. 1. The top view of FIG. 6 clearly illustrates the preferred U-shaped footprint geometry of body positioner 102. This preferred "shape-conforming" geometry preferably allows the unit to be placed closely adjacent the outer bowl surface 126 of the seated-position toilet 106. Thus, body positioner 102 can be placed adjacent the base of seated-position toilet 106 such that geometric plane 148, passing through at least two support surfaces 122 of at least first-plane foot supporter 108 (or more preferably either one of first-plane foot supporter 108 and second-plane foot supporter) preferably intersects at least one portion of seated-position toilet 106, as shown (at least embodying herein shape conformer means for conforming at least one of such non-adjustable-geometry establisher means, such first-plane foot supporter means, and such second-plane foot supporter means to at least one outer surface of the seated-position toilet; wherein such shape conformer means is further configured to permit placement of such positioner means, adjacent the seated-position toilet, such that a plane passing through at least two of such first-plane foot supporter means and such second-plane foot supporter means intersects at least one portion of the seated-position toilet). As a result, the shape-conforming geometry of body positioner 102 is structured and arranged to conform the U-shaped body 120, first-plane foot supporter 108, and second-plane foot supporter 116 to the outer surfaces of the seated-position toilet 106 (at least embodying herein at least one shape conformer structured and arranged to conform at least one of such at least one non-adjustable-geometry establisher, such at least one first-plane foot supporter, and said at least one second-plane foot supporter to at least one outer surface of the seated-position toilet, wherein such at least one shape conformer is further configured to permit placement of such at least one positioner, adjacent the seated-position toilet, such that a plane passing through at least two of such at least one first-plane foot supporter and such at least one second-plane foot supporter intersects at least one portion of the seated-position toilet).

First-plane foot supporter 108 comprises at least one friction-enhancing surface treatment 150 preferably configured to enhance the coefficient of friction between the first pair of generally planar support surfaces 114 and the feet 105 of user 104. In the present preferred embodiment of the system, the friction-enhancing surface treatment 150 preferably comprises a series of approximately parallel raised ridges integrally molded into the first pair of generally planar support surfaces 114, as shown (at least embodying herein at least one friction enhancer configured to enhance friction between such at least one first-plane support surface and the foot of the user). Upon reading this specification, those with ordinary skill in the art will now appreciate that, under appropriate circumstances, considering such issues as design preference, user preferences, marketing preferences, cost, structural requirements, available materials, technological advances, etc., other friction-enhancing arrangements such as, for example, applied surface treatments, co-molded inserts, alternate raised-surface patterns, etc., may suffice.

Similarly, second-plane foot supporter 116 preferably comprises at least one, more preferably two friction-enhancing surface treatments 150, as shown. The friction-enhancing surface treatments 150 of second-plane foot supporter 116 preferably comprises at least one, more preferably two regions of approximately parallel raised ridges that are integrally molded into the second generally planar support surface 118, as shown, to enhance friction between the second generally planar support surface 118 and the right and left feet 105 of user 104.

Preferably, each friction-enhancing surface treatment 150 is preferably arranged to form instructional indicia 152 suggesting the proper placement of feet 105 during use of the apparatus. More specifically, friction-enhancing surface treatment 150 is preferably arranged to graphically suggest the peripheral shape of a foot 105, as shown. This preferred visual cue indicates to user 104 appropriate placement locations of the feet 105 on support surfaces 122.

Figure 7:
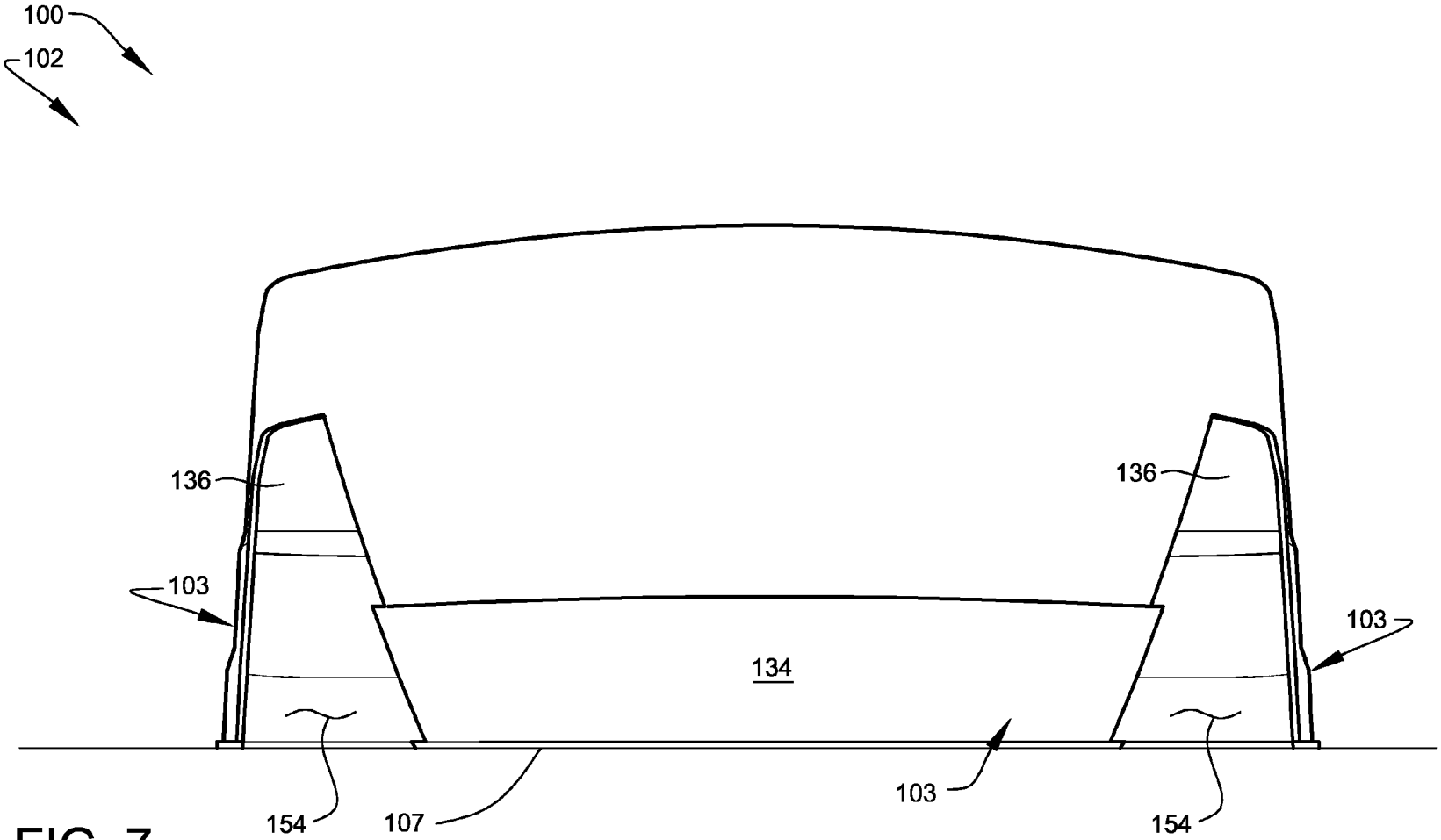
FIG. 7 shows a rear view of the body positioner of FIG. 1.

FIG. 7 shows a rear view of body positioner 102 of FIG. 1. The rear view shows the relatively wide rear support member 103. Also visible in the rear view is the preferred geometry of the right and left side openings 154, which are preferably included to reduce weight, and which can function to assist placement the feet on floor surface 112, by a male individual, when physically addressing the front of seated-position toilet 106, without need to remove body positioner 102.

FIG. 8 shows a diagrammatic side view, illustrating user 104 supported and positioned in second planar foot-support position 111 facilitating defecation during the use of seated-position toilet 106. Second-plane foot supporter 116 preferably assists in positioning the femur 162 of the upper limb at an angle Q5 between about 10 degrees and about 26 degrees above horizontal, with an angle Q5 approaching about 18 degrees being most preferred. Furthermore, such second-plane foot supporter 116 is preferably configured to assist in positioning the tibia 164 of the lower limb at an angle Q6 of between about 12 degrees and about 30 degrees forward of vertical, with an angle Q6 approaching 21 degrees being most preferred.

Figure 9:
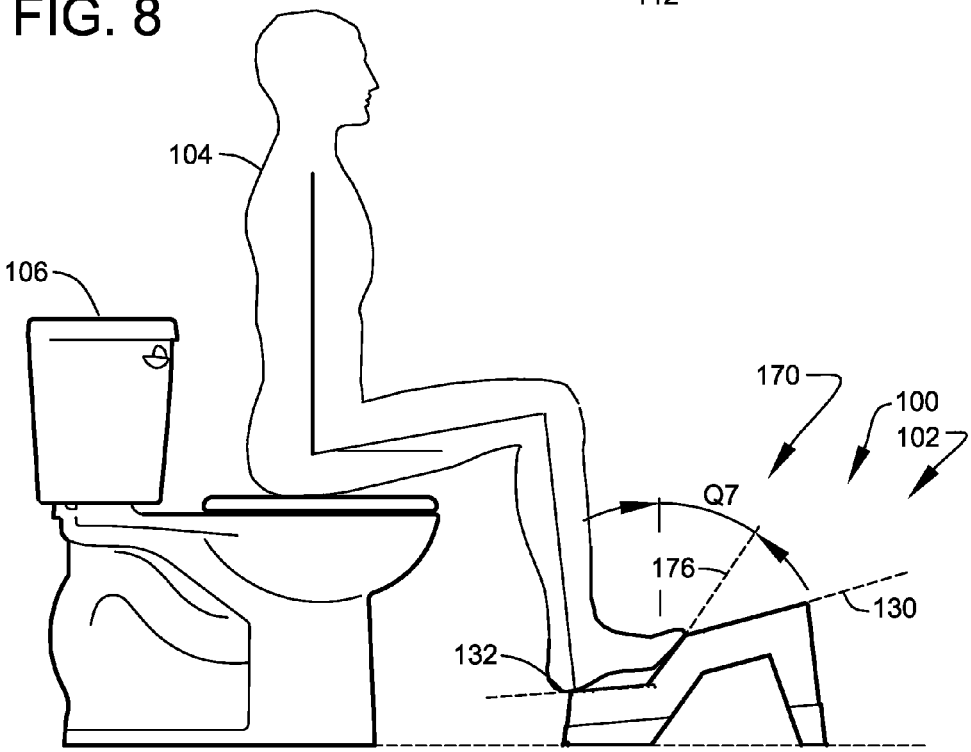
FIG. 9 shows a diagrammatic side view, illustrating a user supported and positioned in another alternate posture facilitating defecation during the use of a seated-position toilet, utilizing the preferred embodiment of FIG. 1.

FIG. 9 shows a diagrammatic side view, illustrating a user supported and positioned in third planar foot-support position 170 facilitating defecation during the use of seated-position toilet 106. It is noted that body positioner 102 further comprises at least one third-plane foot supporter 172 structured and arranged to support, during use of seated-position toilet 106, at least one foot 105 of the seated user 104 in a third planar foot-support position 170 above floor surface adjacent the seated-position toilet 106, as shown (at least embodying herein third-plane foot supporter means for supporting, during use of the seated-position toilet, at least one foot of the seated user in a third planar foot-support position above a floor surface adjacent the seated-position toilet; wherein such third planar foot-support position comprises at least one non-horizontal angle differing from such first planar foot support position and such second planar foot support position)

As also shown in the perspective view of FIG. 1 and top view of FIG. 6, third-plane foot supporter 172 preferably comprises third pair of support surfaces intermediate to the first pair of generally planar support surfaces 114 and upper second generally planar support surface 118. Preferably, third-plane foot supporter 172 comprises at least one third non-horizontal plane 176 comprising an angle Q7 differing from either geometric plane 132 of such first pair of generally planar support surfaces 114 and geometric plane 130 of such second generally planar support surface 118.

Figure 10:
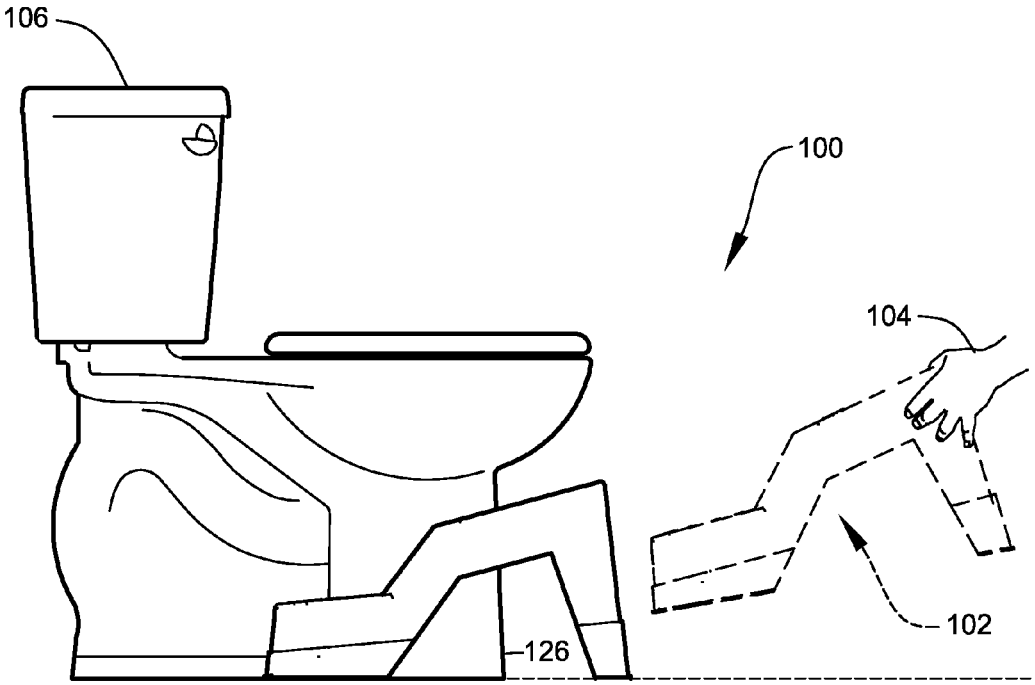
FIG. 10 shows a side view, illustrating the body positioner, according of FIG. 1 in a stowed position.

FIG. 10 shows a side view, illustrating the body positioner, according of FIG. 1 in a stowed position located closely adjacent the front of seated-position toilet 106. The U-shaped geometry allows the unit to be placed closely adjacent the outer bowl surface 126 of the seated-position toilet 106. The dashed-line depiction of FIG. 10 further illustrates a body positioner 102, held by user 104 during relocation between a use and stowed position (at least embodying herein wherein such at least one positioner is configured to be hand carried).

FIG. 11 shows a side view, illustrating a plurality of body positioners 102, arranged in a nested stack 200. The preferred geometry of each body positioner 102 facilitates nested stacking of multiple units one atop the other, as shown. In a preferred embodiment of the system, the side portions 134 are outwardly tapered such that base portion 107 of the side portions 134 are laterally farther apart than the upper portions of the unit, as shown, and thus facilitate stacking and nesting.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. An apparatus, relating to assisting support and positioning of a human body, in at least one posture facilitating defecation during the use of a seated-position toilet, said apparatus comprising:

a) at least one positioner structured and arranged to position the body of a seated user during use of the seated-position toilet;

b) wherein said at least one positioner comprises i) at least one first-plane foot supporter structured and arranged to support, during use of the seated-position toilet, at least one foot of the seated user in a first planar foot-support position above a floor surface adjacent the seated-position toilet, ii) at least one second-plane foot supporter structured and arranged to support, during use of the seated-position toilet, at least one foot of the seated user in a second planar foot support position above the floor surface, and iii) at least one fixed-geometry establisher structured and arranged to establish a fixed non-adjustable geometric relationship between said at least one first-plane foot supporter and said at least one second-plane foot supporter, iv) wherein said at least one first-plane foot supporter is further structured and arranged to support the at least one foot independent from said at least one second-plane foot supporter, and v) wherein said at least one second-plane foot supporter is elevated higher above the floor surface than said at least one first-plane foot supporter; and c) wherein said first planar foot support position comprises a different non-parallel plane from said second planar foot support position;

d) wherein at least one of said at least one first-plane foot supporter and said at least one second-plane foot supporter comprises at least one non-horizontal angle;

e) wherein said at least one positioner is configured to be hand carried; and f) wherein said apparatus assists support and positioning of the body of the seated user, in the posture facilitating defecation during use of a seated-position toilet; and g) at least one shape conformer structured and arranged to conform at least one of said at least one non-adjustable-geometry establisher, said at least one first-plane foot supporter, and said at least one second-plane foot supporter to at least one outer surface of the seated-position toilet;

h) wherein said at least one shape conformer is further configured to permit placement of said at least one positioner, adjacent the seated-position toilet, such that a plane passing through at least two of said at least one first-plane foot supporter and said at least one second-plane foot supporter intersects at least one portion of the seated-position toilet.

2. The apparatus, according to claim 1, further comprising:

a) at least one third-plane foot supporter structured and arranged to support, during use of the seated-position toilet, at least one foot of the seated user in a third planar foot-support position above the floor surface adjacent the seated-position toilet;

b) wherein said at least one third planar foot-support position comprises at least one non-horizontal angle differing from said first planar foot support position and said second planar foot support position.

3. The apparatus, according to claim 1, wherein said at least one first-plane foot supporter further comprises:

a) at least one first-plane support surface having a heel-adjacent portion and a toe-adjacent portion;

b) wherein said at least one first-plane support surface slopes upwardly from said heel-adjacent portion to said toe-adjacent portion at an angle of about 5 degrees from horizontal.

4. The apparatus, according to claim 3, wherein said at least one first-plane support surface further comprises:

a) a length, as measured between said heel-adjacent portion and said toe-adjacent portion, of between about 8 centimeters and about 16 centimeters; and b) a minimum elevation, as measured at said heel-adjacent portion, of between about 6 centimeters and about 12 centimeters above the floor surface.

5. The apparatus, according to claim 3, wherein, during use of the seated-position toilet, said first-plane foot supporter is configured to assist in positioning the femur of the upper limb between about 2 degrees and about 16 degrees above horizontal.

6. The apparatus, according to claim 3, wherein during use of the seated-position toilet, said first-plane foot supporter is configured to assist in positioning the tibia of the lower limb at an angle of between about 2 degrees and about 16 degrees forward of vertical.

7. The apparatus, according to claim 3, wherein during use of the seated-position toilet, said second-plane foot supporter assists in positioning the femur of the upper limb between about 10 degrees and about 26 degrees above horizontal.

8. The apparatus, according to claim 3, wherein during use of the seated-position toilet, said second-plane foot supporter is configured to assist in positioning the tibia of the lower limb at an angle of about 12 degrees to about 30 degrees forward of vertical.

9. The apparatus, according to claim 3, wherein said at least one first-plane foot supporter comprises at least one friction enhancer configured to enhance friction between said at least one first-plane support surface and the foot of the user.

10. The apparatus, according to claim 9, wherein said at least one second-plane foot supporter comprises at least one friction enhancer configured to enhance friction between said at least one second-plane support surface and the foot of the user.

11. The apparatus, according to claim 10, wherein said at least one friction enhancer comprises instructional indicia.

12. The apparatus, according to claim 3, wherein said at least one positioner comprises a single unitary shell.

13. The apparatus, according to claim 3, wherein said at least one positioner comprises at least one nested-stacking geometry structured and arranged to assist nested stacking of two or more of said at least one positioners.

14. The apparatus, according to claim 3, wherein said at least one positioner comprises a polymer material.

15. An apparatus relating to assisting support and positioning of a human body, in at least one posture facilitating defecation during the use of a seated-position toilet, said apparatus comprising:

a) positioner means for positioning the body of a seated user during use of the seated-position toilet;

b) wherein said positioner means comprises i) first-plane foot supporter means for supporting, during use of the seated-position toilet, at least one foot of the seated user in a first planar foot-support position above a floor surface adjacent the seated-position toilet, ii) second-plane foot supporter means for supporting, during use of the seated-position toilet, at least one foot of the seated user in a second planar foot support position above the floor surface, and iii) fixed-geometry establisher means for establishing a fixed non-adjustable geometric relationship between said first-plane foot supporter means and said second-plane foot supporter means, iv) wherein said at least one first-plane foot support means for supporting the at least one foot independent from said at least one second-plane foot supporter;

v) wherein said at least one second-plane foot support means is elevated higher above the floor surface than said at least one first-plane foot support means;

c) wherein said first planar foot support position falls within a different non-parallel plane from said second planar foot support position;

d) wherein at least one of said first-plane foot supporter means and said second-plane foot supporter means comprises at least one non-horizontal angle;

e) wherein said positioner means is configured to be hand carried; and f) wherein said apparatus assists support and positioning of the body of the seated user, in the posture facilitating defecation during use of a seated-position toilet; and g) shape conformer means for conforming at least one of said non-adjustable-geometry establisher means, said first-plane foot supporter means, and said second-plane foot supporter means to at least one outer surface of the seated-position toilet;

h) wherein said shape conformer means if further configured to permit placement of said positioner means, adjacent the seated-position toilet, such that a plane passing through at least two of said first-plane foot supporter means and said second-plane foot supporter means intersects at least one portion of the seated-position toilet.

16. The apparatus, according to claim 15, further comprising:

a) third-plane foot supporter means for supporting, during use of the seated-position toilet, at least one foot of the seated user in a third planar foot-support position above a floor surface adjacent the seated-position toilet;

b) wherein said third planar foot-support position comprises at least one non-horizontal angle differing from said first planar foot support position and said second planar foot support position.

17. An apparatus, relating to assisting support and positioning of a human body, in at least one posture facilitating defecation during the use of a seated-position toilet, said apparatus comprising:

a) at least one positioner structured and arranged to position the body of a seated user during use of the seated-position toilet;

b) wherein said at least one positioner comprises i) at least one first-plane foot supporter structured and arranged to support, during use of the seated-position toilet, at least one foot of the seated user in a first planar foot-support position above a floor surface adjacent the seated-position toilet, ii) at least one second-plane foot supporter structured and arranged to support, during use of the seated-position toilet, at least one foot of the seated user in a second planar foot support position above the floor surface, and iii) at least one fixed-geometry establisher structured and arranged to establish a fixed non-adjustable geometric relationship between said at least one first-plane foot supporter and said at least one second-plane foot supporter, iv) wherein said at least one first-plane foot supporter is further structured and arranged to support the at least one foot independent from said at least one second-plane foot supporter, and v) wherein said at least one second-plane foot supporter is elevated higher above the floor surface than said at least one first-plane foot supporter; and c) wherein said first planar foot support position comprises a different non-parallel plane from said second planar foot support position;

d) wherein at least one of said at least one first-plane foot supporter and said at least one second-plane foot supporter comprises at least one non-horizontal angle;

e) wherein said at least one positioner is configured to be hand carried;

f) wherein said apparatus assists support and positioning of the body of the seated user, in the posture facilitating defecation during use of a seated-position toilet;

g) wherein said at least one first-plane foot supporter further comprises:

i) at least one first-plane support surface having a heel-adjacent portion and a toe adjacent portion;

ii) wherein said at least one first-plane support surface slopes upwardly from said heel-adjacent portion to said toe-adjacent portion at an angle of about 5 degrees from horizontal; and h) wherein said second-plane foot supporter comprises:

i) at least one second-plane support surface having a heel-adjacent portion and a toe-adjacent portion, and ii) a minimum elevation, as measured at said heel-adjacent portion, of between about 12 centimeters and about 28 centimeters above the floor surface, iii) wherein said at least one second-plane support surface slopes upwardly from said heel-adjacent portion to said toe-adjacent portion at an angle of about 23 degrees from horizontal.

* * * * *